US007246497B2

(12) United States Patent
Akselband et al.

(10) Patent No.: US 7,246,497 B2
(45) Date of Patent: Jul. 24, 2007

(54) MIST GENERATION, FREEZING, AND DELIVERY SYSTEM

(75) Inventors: Boris Akselband, Brighton, MA (US); Charles C. Carswell, Weston, MA (US); Craig R. Carswell, Arlington, MA (US); Richard Goldman, Stoughton, MA (US); Kathryn Whitenack, Andover, MA (US)

(73) Assignee: Lytron, Inc., Woburn, MA (US)

( * ) Notice: Subject to any disclaimer, the term of this patent is extended or adjusted under 35 U.S.C. 154(b) by 261 days.

(21) Appl. No.: 11/154,027

(22) Filed: Jun. 16, 2005

(65) Prior Publication Data

US 2005/0279108 A1 Dec. 22, 2005

Related U.S. Application Data

(60) Provisional application No. 60/580,201, filed on Jun. 16, 2004.

(51) Int. Cl.
*F25C 3/04* (2006.01)

(52) U.S. Cl. ..... 62/74; 62/347; 239/2.2

(58) Field of Classification Search ..... 62/74, 62/347; 239/2.2, 14.2
See application file for complete search history.

(56) References Cited

U.S. PATENT DOCUMENTS

| | | | | |
|---|---|---|---|---|
| 4,081,257 | A | 3/1978 | Lassmann et al. | 62/532 |
| 4,748,817 | A | 6/1988 | Oura et al. | 62/74 |
| 4,769,054 | A | 9/1988 | Steigman | 62/12 |
| 5,035,750 | A | 7/1991 | Tada et al. | 134/7 |
| 5,327,738 | A * | 7/1994 | Morioka et al. | 62/74 |
| 5,445,320 | A | 8/1995 | Berthelier | 239/2.2 |

* cited by examiner

*Primary Examiner*—William E. Tapolcai
(74) *Attorney, Agent, or Firm*—Weingarten, Schurgin, Gagnebin & Lebovici LLP

(57) ABSTRACT

The present invention provides a system that generates particles of mist, freezes the mist particles, and delivers a mixture of a gas and the solid mist particles to an external application.

33 Claims, 1 Drawing Sheet

MIST GENERATION, FREEZING, AND DELIVERY SYSTEM

CROSS REFERENCE TO RELATED APPLICATIONS

This application claims the benefit under 35 U.S.C. § 119(e) of U.S. Provisional Patent Application No. 60/580,201, filed Jun. 16, 2004, the disclosure of which is incorporated by reference herein.

STATEMENT REGARDING FEDERALLY SPONSORED RESEARCH OR DEVELOPMENT

N/A

BACKGROUND OF THE INVENTION

Systems are known that produce solid particles by freezing for various applications. U.S. Pat. No. 4,748,817 describes a method and apparatus for producing microfine frozen particles. U.S. Pat. No. 5,445,320 describes a method of and equipment for snow production. U.S. Pat. No. 4,769,054 describes the abatement of vapors from gas streams by solidification. U.S. Pat. No. 5,035,750 describes a processing method for semiconductor wafers including forming frozen particles. U.S. Pat. No. 4,081,257 describes freeze regeneration of glycol solutions loaded with water.

SUMMARY OF THE INVENTION

The present invention provides a system that generates particles of mist, freezes the mist particles, and delivers a mixture of a gas and the solid mist particles to an external application.

More particularly, the system includes a mixture of gas and frozen mist particles circulating on a circulatory flow path. A portion of the mixture is removed, continuously or periodically, from the circulatory flow path as needed for the external application. A liquid mist generator is located on an incoming flow path to introduce liquid mist into the mixture of gas and frozen mist particles on the circulatory flow path. The amount of liquid mist introduced is equivalent to the amount of gas/frozen mist that has been removed. The mixture of gas and frozen mist particles has a temperature and flow rate sufficient to freeze introduced liquid mist while mixing and flowing along a cooling portion of the circulatory flow path. A heat removal device on the circulatory flow path further cools the mixture of gas and frozen mist to a desired temperature.

DESCRIPTION OF THE DRAWING

The invention will be more fully understood from the following detailed description taken in conjunction with the accompanying drawing in which.

DETAILED DESCRIPTION OF THE INVENTION

Figure 1:
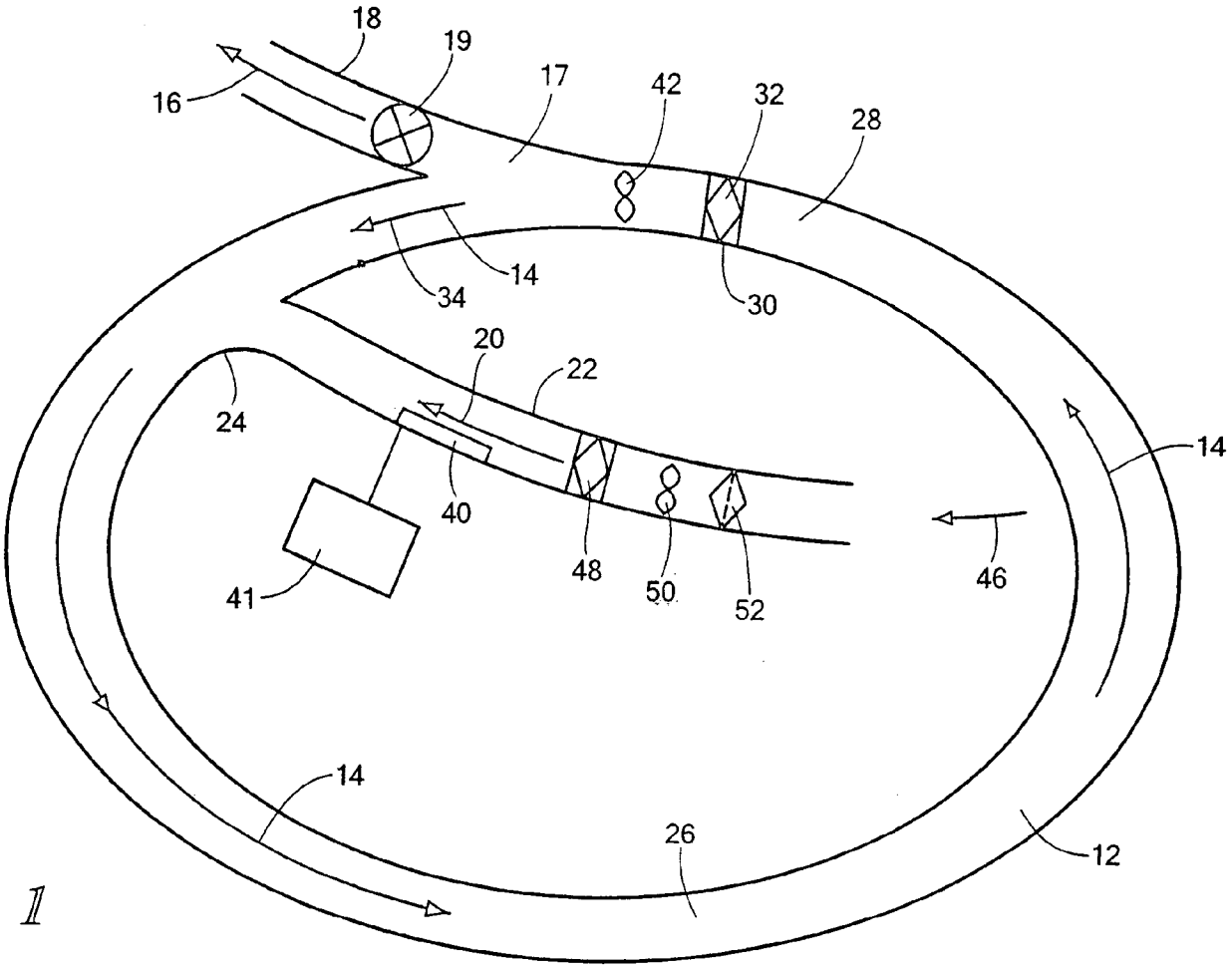
FIG. 1 is a schematic illustration of a mist generation, freezing, and delivery system according to the present invention.

The present invention provides a system that generates particles of mist, freezes the mist particles, and delivers a mixture of a gas and the solid mist particles to an external application. The gas and the frozen mist particles can be any suitable material depending on the application. For example, a mixture of air and a mist of water ice is suitable for various cooling applications. The mist particles must be small enough that they do not coagulate into larger particles.

FIG. 1 illustrates the present mist generation, freezing, and delivery system generally. The system provides a circulatory flow path or loop 12 along which a mixture of a gas and a solid mist continuously circulates, indicated schematically by arrows 14, described further below. A portion 16 of the gas/solid mist is removed through an outlet 17 on an outgoing flow path 18 for delivery to a desired application. Depending on the application, the gas/solid mist can be removed continuously or periodically. A valve 19 is located in the outgoing flow path 18 to control flow onto the path 18. Any suitable valve may be provided. The valve 19 is controlled by the system calling for the frozen mist.

A gas and liquid mist mixture, indicated schematically by arrow 20, is generated by a liquid mist generator 40 in an incoming flow path 22 and introduced continuously or periodically into the circulatory flow path 12 in an equivalent mass to replace the mass of gas/solid mist that has been removed. The ratio of gas to liquid mist depends on the external application and the thermodynamics and can be readily determined and adjusted, as would be appreciated by those of skill in the art.

The incoming gas/liquid mist 20 enters the flow path 12 at inlet 24 and begins to mix with the colder circulating gas/solid mist 14 on the circulatory flow path. As they mix, the colder circulating gas/solid mist 14 cools the incoming gas/liquid mist 20 via convection to a temperature at which the liquid mist freezes to form a solid mist as flow proceeds along a portion 26 of the circulatory flow path. Other or supplemental cooling, such as cooling pipes surrounding the circulatory flow path portion 26, could be provided.

When the liquid mist has frozen, at a region 28 at a downstream end of the portion 26, the cool gas/solid mist mixture is cooled further at a subcooling heat removal location 30 to a temperature further below the freezing point of the mist material. The heat removal location may be provided by, for example, a suitable heat exchanger 32 located in the flow path 12. Downstream of the subcooling heat removal location, the portion 16 of the cold gas/solid mist is removed for the desired application, as noted above. The remainder 34 of the cold gas/solid mist mixture continues circulating on the flow path to cool the incoming replacement gas/liquid mist 20. The temperature to which the gas/solid mist is cooled in the subcooling heat removal location 30 is selected based on the external application and the cooling requirements of the incoming replacement gas/liquid mist. In the embodiment illustrated, the heat exchanger 32 is located slightly upstream of the outlet 17. The heat exchanger could be located elsewhere along the circulatory flow path 12, depending, for example, on the desired output temperature. For example, the heat exchanger could be located along the path downstream of the outlet 17 and upstream of the inlet 24 to provide a warmer output temperature.

A number of other considerations are taken into account to achieve adequate generation and freezing of the mist material. The liquid and solid mist particles must be small enough to remain atomized in the gas along the circulatory flow path 12 without coalescing into larger particles, attaching to the structure, or attaching to cooling surfaces. Generally, particles of less than 15 micrometers and preferably less than 10 micrometers are suitable. Particles ranging from 1 to 10 micrometers can be generated by, for example, controlling the frequency and energy level of an ultrasonic liquid mist generator 40, as would be known by one of skill in the art. A fine particle size also assists the freezing process on the circulatory flow path because it increases the particles' surface area relative to the particles' mass.

To achieve good heat transfer between the circulating gas/solid mist and the incoming gas/liquid mist so that the gas/liquid mist becomes a gas/solid mist at the desired density, freezing rate, and temperature, a sufficiently high flow rate along the circulatory flow path 12 is needed. To achieve higher internal mass flow rates, circulation of the gas/solid mist mixture is forced, for example, by a recirculating fan 42 or other flow moving device located upstream or downstream of the heat removal location 30. The flow rate along the path, the path length, the temperatures at the output of the subcooling heat removal location and the incoming replacement gas/liquid mist, and specific heats based on the materials selected are readily selected and controlled to achieve the desired cooling, as will be appreciated by one of skill in the art.

As noted above, flow out of the system is balanced by an equivalent flow into the system. The flows in and out can be balanced by the head pressure of a fan 50. The circuit has a slight positive pressure that matches the fan head pressure. When the system pressure drops as mist is removed from the system, the fan's head pressure becomes greater than the system pressure, so gas flows into the system until the system pressure increases to the fan head pressure. The flow can be balanced in other ways, such as by providing a valve in the incoming flow path 22 and a controller that opens the incoming valve when the outgoing valve 19 is opened.

Introduction of the incoming gas/liquid mist on the incoming flow path 22 into the circulatory flow path 12 is illustrated schematically in FIG. 1. A suitable nozzle or other inlet configuration is provided to ensure that the inlet does not become plugged with frozen mist, as could be determined by one of skill in the art.

In one example, water mist is frozen to form ice mist particles in a mixture with air. Air and liquid water mist enter the circulatory flow path at the entrance 24 at a temperature greater than 0° C., the freezing temperature of water. As the air and liquid water mist mix with the air and ice mist along the flow path portion 26, all the liquid water freezes. At the region 28, the temperature is below 0° C. After passing through the heat removal location 30, the temperature of the air and ice mist mixture is much less than 0° C.

Referring to the incoming flow, the liquid mist generator 40 is located on the incoming flow path 22. Any suitable liquid mist generator may be used. The liquid mist is mixed with a gas, such as air 46. An incoming heat exchanger 48 cools the gas down to a temperature that is still above the freezing point of the mist material, and a fan or other air moving device 50 pressurizes the flow. If necessary or desired, the incoming replacement gas is conditioned prior to entry into the circulatory flow path. The gas may be passed through a filter 52 to remove particulates and/or a dehumidifier 52 to remove moisture. If desired, a mixture of gases can be provided, or air, if used, can be enriched with oxygen or some other gas.

The mist generator 40 is controlled so that it only introduces mist as gas is introduced into the system to replace outgoing frozen mist or to bring the mist concentration in the system up to a predetermined level. Any suitable control mechanism can be used. For example, a valve can be provided that allows flow through only when needed. In another alternative, a pressure sensor can be provided in the system to determine when the pressure in the system drops below a predetermined level, thereby indicating a need for the introduction of gas and liquid mist. In still another alternative, a sensor can be provided in the system to detect the concentration of mist in the system. A controller 41 is provided in communication with the valve, pressure sensor, or concentration sensor, as appropriate, to control the mist generator.

The generated gas/solid mist can be used for a variety of applications, such as backside wafer cooling, rapid body cooling for induced hypothermia, rapid material quenching, pharmaceutical manufacture, blood cooling, rapid cooling of foods, etc.

The invention is not to be limited by what has been particularly shown and described, except as indicated by the appended claims.

What is claimed is:

1. A mist generation, freezing, and delivery system, comprising:

a circulatory flow path, an incoming flow path including an inlet onto the circulatory flow path, and an outgoing flow path including an outlet from the circulatory flow path;

a mixture of gas and frozen mist particles circulating on the circulatory flow path;

a liquid mist generator located on the incoming flow path to introduce a mixture of gas and liquid mist through the inlet into the mixture of gas and frozen mist particles on the circulatory flow path;

the mixture of gas and frozen mist particles having a temperature and flow rate sufficient to freeze introduced liquid mist while mixing and flowing along a cooling portion of the circulatory flow path; and a heat removal device located on the flow path and operative to further cool the mixture of gas and frozen mist.

2. The system of claim 1, wherein the circulatory flow path has a length to provide a desired cooling of the liquid mist along a portion of the circulating flow path.

3. The system of claim 1, further comprising a cooling device in heat exchange relationship with the cooling portion of the circulatory flow path.

4. The system of claim 3, wherein the cooling device comprises cooling pipes surrounding the cooling portion of the circulatory flow path.

5. The system of claim 1, wherein the heat removal device comprises a subcooling heat exchanger.

6. The system of claim 1, wherein the heat removal device is located downstream from the cooling portion of the circulating flow path and upstream from the outlet from the circulatory flow path.

7. The system of claim 1, wherein the heat removal device is located at a downstream region of the portion of the circulatory flow path.

8. The system of claim 1, wherein the heat removal device is located downstream from the outlet from the circulatory flow path and upstream from the inlet onto the circulatory flow path.

9. The system of claim 1, wherein the heat removal device is located at a downstream region of the portion of the circulatory flow path and upstream of the outlet from the circulatory flow path.

10. The system of claim 1, further comprising a flow moving device located on the circulatory flow path.

11. The system of claim 10, wherein the flow moving device comprises a fan.

12. The system of claim 10, wherein the flow moving device is located downstream of the heat exchanger.

13. The system of claim 10, wherein the flow moving device is located upstream of the heat exchanger.

14. The system of claim 1, further comprising a valve in the outgoing flow path.

15. The system of claim 1, further comprising an incoming heat exchanger located on the incoming flow path upstream of the liquid mist generator operative to cool incoming gas.

16. The system of claim 1, further comprising an incoming flow moving device located on the incoming flow path upstream of the liquid mist generator operative to introduce gas into the incoming flow path.

17. The system of claim 16, wherein the incoming flow moving device comprises a fan.

18. The system of claim 1, further comprising a gas conditioner located on the incoming flow path.

19. The system of claim 1, further comprising a filter located on the incoming flow path.

20. The system of claim 1, further comprising a gas dehumidifier located on the incoming flow path.

21. The system of claim 1, further comprising a controller in communication with the liquid mist generator.

22. The system of claim 21, wherein the controller is in further communication with a pressure sensor in the circulatory flow path to operate the liquid mist generator to generate liquid mist when pressure in the circulatory flow path is below a determined pressure.

23. The system of claim 21, wherein the controller is in further communication with a valve in the outlet from the circulatory flow path to operate the liquid mist generator when the valve is opened to allow the mixture of gas and frozen mist particles therethrough.

24. The system of claim 21, wherein the controller is in further communication with a mist concentration sensor in the circulatory flow path to operate the liquid mist generator to generate liquid mist when a concentration of frozen mist particles is below a determined concentration.

25. The system of claim 1, further comprising a nozzle in the inlet onto the circulatory flow path.

26. The system of claim 1, wherein the mixture of gas and frozen mist particles comprises a mixture of air and ice mist particles, and the liquid mist generator is operative to generate water mist.

27. A method of mist generation, freezing, and delivery, comprising:

circulating a mixture of gas and frozen mist on a circulatory flow path;

removing a portion of the mixture of gas and frozen mist from the circulatory flow path;

introducing a mixture of gas and liquid mist into the mixture of gas and frozen mist on the circulatory flow path in an amount equivalent to an amount of the removed portion of the mixture of gas and frozen mist;

freezing the liquid mist on a portion of the circulatory flow path by mixing with the mixture of gas and frozen mist; and cooling the mixture of gas and frozen mist to a temperature further below a freezing temperature of the frozen mist.

28. The method of claim 27, further comprising forcing flow of the mixture of gas and frozen mist on the circulatory flow path.

29. The method of claim 27, further comprising cooling the liquid mist on an incoming flow path to a temperature above a freezing temperature of the liquid mist prior to the step of introducing the liquid mist onto the circulatory flow path.

30. The method of claim 27, further comprising removing the mixture of gas and frozen mist periodically from the circulatory flow path.

31. The method of claim 27, further comprising removing the mixture of gas and frozen mist continuously from the circulatory flow path.

32. The method of claim 27, further comprising introducing the mixture of gas and liquid mist on the circulatory flow path when a pressure on the circulatory flow path drops below a determined pressure.

33. The method of claim 27, wherein the mixture of gas and frozen mist particles comprises a mixture of air and frozen water ice particles, and the liquid mist comprises a mixture of air and liquid water mist.

* * * * *